US007063586B2

(12) United States Patent
Scott et al.

(10) Patent No.: US 7,063,586 B2
(45) Date of Patent: Jun. 20, 2006

(54) CERAMIC DISCHARGE CHAMBER FOR A DISCHARGE LAMP

(75) Inventors: Curtis Edward Scott, Mentor, OH (US); Jack M. Strok, Garrettsville, OH (US); Douglas Seredich, Montville, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/720,413

(22) Filed: Nov. 24, 2003

(65) Prior Publication Data

US 2004/0113557 A1 Jun. 17, 2004

Related U.S. Application Data

(63) Continuation of application No. 09/707,408, filed on Nov. 6, 2000, now abandoned.

(51) Int. Cl.
*H01J 9/24* (2006.01)

(52) U.S. Cl. ..... 445/26; 445/22; 313/493; 264/382.1

(58) Field of Classification Search ..... 264/328.9, 264/328.1, 328.16, 328.7, 328.11, 313, 632, 264/635, 645; 445/26, 22; 313/625, 634, 313/493; 425/577
See application file for complete search history.

(56) References Cited

U.S. PATENT DOCUMENTS

| | | | | |
|---|---|---|---|---|
| 4,285,732 | A | 8/1981 | Charles et al. | |
| 4,387,067 | A | 6/1983 | Kobayashi et al. | |
| 4,799,601 | A | 1/1989 | Shimai et al. | |
| 5,725,827 | A | 3/1998 | Rhodes et al. | |
| 6,004,503 | A | 12/1999 | Neil | |
| 6,126,887 | A | 10/2000 | Ward et al. | |
| 6,204,902 | B1 * | 3/2001 | Kim et al. | 349/112 |
| 6,215,254 | B1 | 4/2001 | Honda et al. | |
| 6,583,563 | B1 * | 6/2003 | Venkataramani et al. | 313/634 |
| 6,953,503 | B1 * | 10/2005 | Miyazawa et al. | 106/287.1 |

FOREIGN PATENT DOCUMENTS

| | | | |
|---|---|---|---|
| EP | 0 954 010 A1 | | 11/1991 |
| EP | 0 587 238 A1 | | 3/1994 |
| JP | 48061514 A | * | 8/1973 |
| JP | 07047518 A | * | 2/1995 |

* cited by examiner

*Primary Examiner*—Karabi Guharay
(74) *Attorney, Agent, or Firm*—Fay, Sharpe, Fagan, Minnich & McKee, LLP

(57) ABSTRACT

A discharge chamber for a lamp, the discharge chamber comprising a monolithic ceramic article having a main body defining an arc chamber and generally opposed leg members defining openings which may accommodate an electrode or electrode lead through. A method of making a ceramic discharge chamber comprising the steps of forming a mixture comprised of ceramic powder and a binder and injecting the mixture into a die and around a mold to form at least a main body of the discharge chamber.

11 Claims, 3 Drawing Sheets

CERAMIC DISCHARGE CHAMBER FOR A DISCHARGE LAMP

This application is a continuation of application Ser. No. 09/707,408, filed Nov. 6, 2000, now abandoned.

BACKGROUND OF THE INVENTION

Field of the Invention

This invention relates generally to lighting, and more particularly, to ceramic discharge chambers for a lamp, such as a ceramic metal halide lamp or a high pressure sodium discharge lamp. This invention also relates to a method of manufacturing ceramic arc chambers.

Discharge lamps produce light by ionizing a fill such as a mixture of metal halides and mercury with an electric arc passing between two electrodes. The electrodes and the fill are sealed within a translucent or transparent discharge chamber which maintains the pressure of the energized fill material and allows the emitted light to pass through it. The fill, also known as a "dose", emits a desired spectral energy distribution in response to being excited by the electric arc.

The discharge chamber in a discharge lamp can be formed from a vitreous material such as fused quartz, which is shaped into a desired chamber geometry after being heated to a softened state. Fused quartz, however, has certain disadvantages which arise from its reactive properties at high operating temperatures. For example, at temperatures greater than about 950 to 1,000° C., the halide fill reacts with the glass to produce silicates and silicon halide, reducing the quantity of fill constituents. Elevated temperatures also cause sodium to permeate through the quartz wall. These fill depletions cause color shift over time, which reduces the useful life of the lamp.

Ceramic discharge chambers were developed to operate at high temperatures for improved color temperatures, color renderings, and luminous efficacies, while significantly reducing reactions with the fill material. U.S. Pat. Nos. 4,285,732 and 5,725,827, for example, disclose translucent polycrystalline sintered bodies where visible wavelength radiation is sufficiently able to pass through to make the body useful for use as an arc tube.

Typically, ceramic discharge chambers are constructed from a number of parts extruded or die pressed from a ceramic powder and then sintered together. For example, referring now to European Patent Application No. 0587238, five ceramic parts are used to construct the discharge chamber of a metal halide lamp. Two end plugs with a central bore are fabricated by die pressing a mixture of a ceramic powder and binder. A central cylinder and the two legs are produced by extruding a ceramic powder/binder mixture through a die. After forming the part, it is air sintered between 900–1400° C. to remove organic processing aids. Assembly of the discharge chamber requires tacking of the legs to the cylinder plugs, and the end plugs into the end of the central cylinder. This assembly is then sintered to form joins which are bonded by controlled shrinkage of the individual parts.

Typically, ceramic discharge chambers are constructed from a number of parts extruded or die pressed from a ceramic powder. For example, end plugs with the central bore may be fabricated by die pressing a mixture comprising a ceramic powder and an organic binder. A central cylinder, and the two legs may be produced by extruding a ceramic powder/binder mixture through a die. Assembly of the discharge chamber involves the placement and tacking of the legs to the end plugs and the end plugs into the ends of the central cylinder. This final assembly is then sintered to form four joins which are bonded by controlled shrinkage of the individual parts.

The conventional ceramic discharge chamber method of construction has a number of disadvantages. For example, the number of component parts is relatively large and introduces the corresponding number of opportunities for variation and defects. Also, the conventional discharge chamber includes four bonding regions, each of which introduces an opportunity for lamp failure by leakage of the fill material if the bond is formed improperly. Each bonding area also introduces a region of relative weakness, so that even if the bond is formed properly, the bond may break during handling or be damaged enough in handling to induce failure in operation.

Another disadvantage relates to the precision with which the parts can be assembled and the resulting effect in the light quality. It is known that the light quality is dependent to a substantial extent on the voltage across the electrode gap, which in turn requires the size of the gap to consistently fall within an acceptable tolerance. Preferably, this result is achieved without significant effort devoted to optimizing the manufacturing process. However, divergent shrinkage rates of variously shaped components limit the ability to manufacture in a reliable manner. Accordingly, it would be desirable to minimize the component parts necessary to manufacture the ceramic arc chamber.

BRIEF SUMMARY OF THE INVENTION

According to an exemplary embodiment of the invention, a discharge chamber for a lamp is provided. The discharge chamber is comprised of a monolithic ceramic article having a main body defining an arc chamber and at least one end member defining an opening which can accommodate an electrode or lead through for an electrode. A second end member can be formed as part of the monolithic body or as a separate component.

In a further exemplary embodiment of the invention, the discharge chamber is manufactured by a method including the steps of forming a mixture of ceramic powder and a binder. The mixture is then injection molded in a die to form at least a main body section of the discharge chamber. The injection molding step includes forming the main body portion around a mold to create the arc chamber. The method of the invention and the resultant product can greatly facilitate the manufacturing process for ceramic arc discharge tubes because the discharge chambers can be constructed of one monolithic body or a monolithic body having one main body and end member and a separate second end member. The reduction in the number of bonds reduces the number of potential bond defects and reduces the possibility of breakage of the discharge chamber at the bond region during handling. Exemplary embodiments of the invention can be used to improve the performance of various types of lamps such as metal halide lamps, high pressure mercury vapor lamps, and high pressure sodium vapor lamps.

BRIEF DESCRIPTION OF THE DRAWINGS

Other features and advantages of the invention will be more readily understood upon reading the following detailed description in conjunction with the drawings in which.

DETAILED DESCRIPTION OF THE INVENTION

Figure 1:
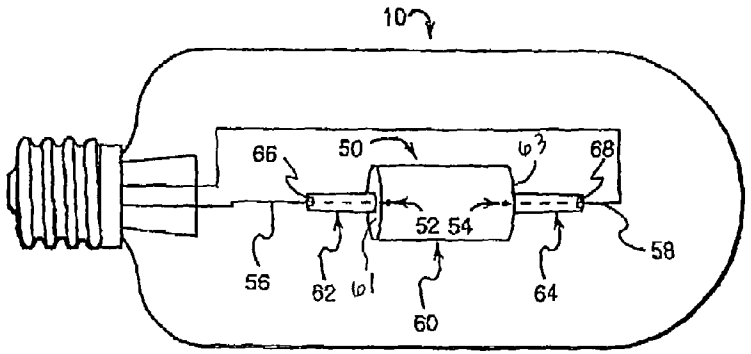
FIG. 1 illustrates a light source which includes a ceramic discharge chamber according to an exemplary embodiment of the invention.

FIG. 1 illustrates a discharge lamp 10 according to an exemplary embodiment of the invention. Discharge lamp 10 includes a discharge chamber 50 which contains two electrodes 52, 54 and fill material (not shown). Electrodes 52, 54 are connected to conductors 56, 58, which apply a potential difference across the electrodes. In operation, the electrodes 52, 54 produce an arc which ionizes a fill material to produce a plasma in the discharge chamber 50. The emission characteristics of the light produced by the plasma depend primarily on the constituents of the fill material, the voltage across the electrodes, the temperature distribution of the chamber, the pressure in the chamber, and the geometry of the chamber. For a ceramic metal halide lamp, the fill may typically comprise a mixture of Hg, a rare gas such as Ar or Xe and a metal halide such as NaI, ThI, $DyI_3$. For high pressure sodium lamp, the fill material typically comprises sodium, a rare gas, and Hg. Other fill materials are also well known in the art, and the present invention is believed to be suitable for operation with any of those recognized ionizable materials.

As shown in FIG. 1, the discharge chamber 50 comprises a central body portion 60; and two end members 61, 63 including leg portions 62, 64. The ends of the electrodes 52, 54 are typically located near the opposite ends of the body portion 60. The electrodes are connected to a power supply by the conductors 56, 58 which are disposed within a central bore of each leg portion 62, 64. The electrodes are typically comprised of tungsten. The conductors typically comprise molybdenum and niobium, the niobium having a thermal expansion coefficients close to that of alumina to reduce thermally induced stresses on the alumina leg portion 62, 64.

The discharge chamber 50 is sealed at the ends of the leg portions 62, 64 with seals 66, 68. The seal 66, 68 typically comprise a disprosia-alumina-silica glass that can be formed by placing a glass frit in the shape of a ring around one of the conductors, eg. 56, aligning the discharge chamber 50 vertically and melting the frit. The melted glass then flows down into the leg 62, forming a seal between the conductor 56 and the leg 62. The discharge chamber is then turned upside down to seal the other leg 64 after being filled with the fill material.

The leg portion 62, 64, extends axially away from the center of the discharge chamber 50. The dimensions of the leg portions 62, 64 are selected over the temperature of the seal 66, 68 by desired amount with respect to the center of the discharge chamber 50. For example, in a 70 watt lamp, the leg portion portions have a length of about 10–15 mm, an inner diameter of 0.8–1.0 mm and an outer diameter of about 2.5–3.0 mm to lower the temperature at the seal 66, 68 to about 600 to 700° C., which is about 400° C. less than the temperature at the center of the discharge chamber. In a 35 watt lamp, the leg portions have a length of about 10–15 mm, an inner diameter of 0.7 to 0.8 mm and an outer diameter of about 2.0–2.5 mm. In a 150 watt lamp, the leg portions have a length of about 12–15 mm and an inner diameter of about 0.9–1.1 mm, and an outer diameter of about 2.5–3.0 mm. These dimensions, and others through the specification, are of course given as examples and are not intended to be limiting.

The body portion 60 of the discharge chamber is typically substantially cylindrical. For a 70 watt lamp, the body portion typically has an inner diameter of about 7 mm and outer diameter of about 8.5 mm. For a 35 watt lamp, the body portion typically has an inner diameter of about 5 mm and an outer diameter of about 6.5 mm. For a 150 watt lamp, the body portion typically has an inner diameter of about 9.5 mm and an outer diameter of 11.5 mm.

Figure 2:
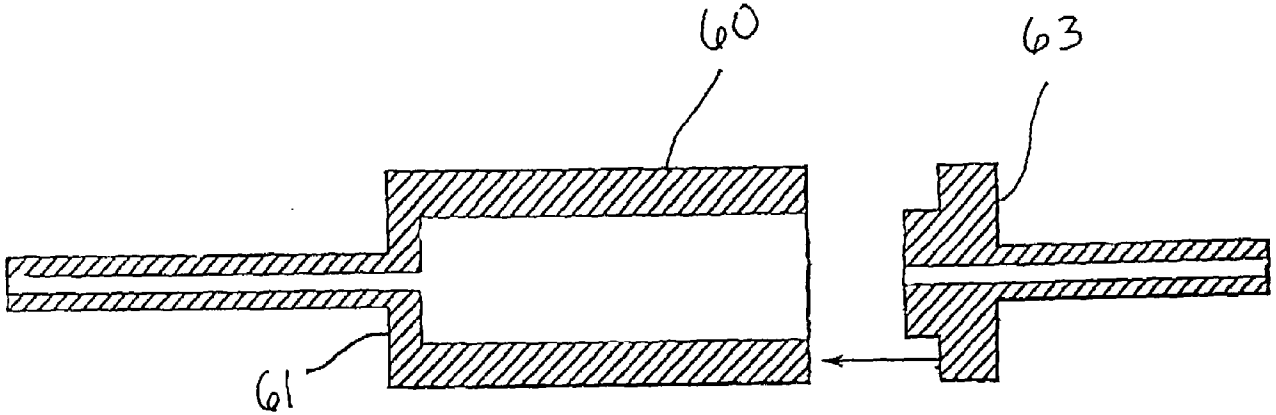
FIG. 2 represents a detailed view of the pre-assembled discharge chamber.

Referring now to FIG. 2, the body portion 60 and at least one end member 61 are monolithically formed by injection molding. The chamber of FIG. 2 is of a type formed in the apparatus of FIG. 4 wherein only one end member is monolithic to the main body. However, as will be clear upon reading the entirety of this disclosure, the present invention also provides a method for forming both end members 61 and 63 monolithically with body portion 60.

The ceramic mixture used to form the chamber can comprise 60–90% by weight ceramic powder and 2–25% by weight organic binder. The ceramic powder may comprise alumina ($Al_2O_3$) having a purity of at least 99.98% and a surface area of about 1.5 to about 10 $m^2/g$, typically between 3–5 $m^2/g$. The ceramic powder may be doped with magnesia to inhibit grain growth, for example in an amount equal to 0.03%–0.2%, preferably 0.05% by weight of the alumina. Other ceramic materials which may be used include non-reactive refractory oxides and oxynitrides such as. yttrium oxide and hafnium oxide and compounds of alumina such as yttrium-alumina-garnet and aluminum oxynitride. Binders which may be used individually or in combination include organic polymers, such as polyols, polyvinyl alcohol, vinyl acetates, acrylates, cellulosics, polyesters, stearates and waxes.

According to one example, the binder comprises:

33⅓ parts by weight parafin wax, melting point 52–58° C.;

33⅓ parts by weight parafin wax, melting point 59–63° C.; and

33⅓ parts by weight parafin wax, melting point 73–80° C.

The following substances are added to the 100 parts by weight parafin wax.

4 parts by weight white beeswax;

8 parts by weight oleic acid;

3 parts by weight aluminum stearate.

In the process of injection molding, the mixture of ceramic material and binder is heated to form a highly viscous mixture. The mixture is then injected into a suitably shaped mold and then subsequently cooled to form a molded part. Subsequent to injection molding, the binder is removed from the molded part, typically by thermal treatment, to form a debindered part. The thermal treatment may be conducted by heating the molded part in air or a controlled environment, e.g., a vacuum, nitrogen, rare gas, to a maximum temperature, and then holding the maximum temperature. For example, the temperature may be solely increased by about 2–3° C. per hour from room temperature to a temperature of 160° C. Next, the temperature is increased by about 100° C. per hour to a maximum temperature of 900–1100° C. Finally, the temperature is held at 900–1100° C. Finally, the temperature is held at 900–1100° C. for about 1–5 hours. The part is subsequently cooled. After the thermal treatment step, the porosity is usually about 40–50%.

Figure 3:
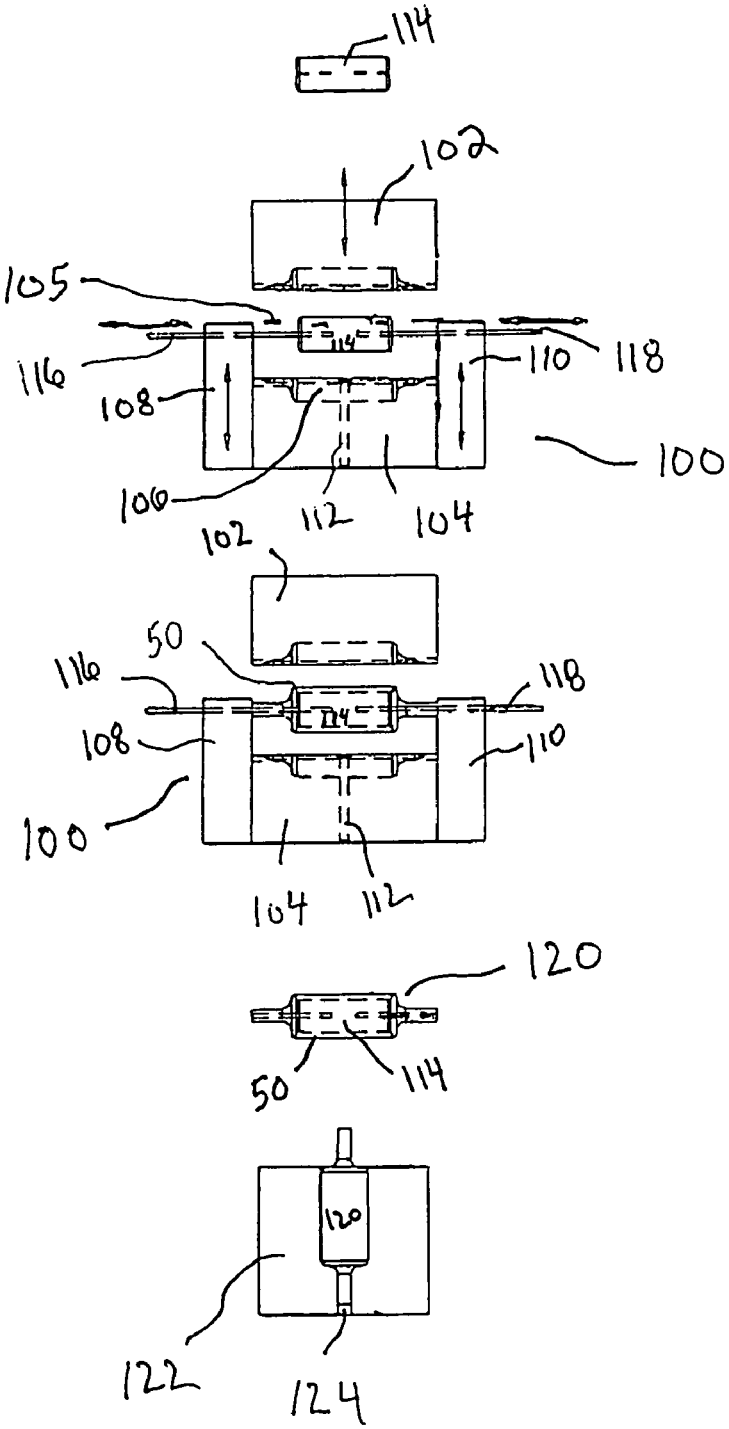
FIG. 3 schematically represents one exemplary injection molding process of the invention.

Referring now to FIG. 3, molding die 100 is depicted, including a top unit 102 and bottom unit 104, the top half 102 being removable perpendicular to the axis 105 of a molding chamber 106 formed when halves 102 and 104 are joined. The ends of the die 100 are bound by retractable blocks 108, 110. Injection molding passage 112 is provided in die 100. A plug 114 is supported within a molding chamber 106 via support pins 116 and 118 which are themselves supported on retractable blocks 108, 110. The die is appropriately designed to provide close tolerance clearance between the walls of die halves 102 and 104, the support pins 116 and 118 and the plug 114. Moreover, the desired clearance is provided to form appropriate wall thicknesses for discharge chamber 50 when ceramic material is injected through passage 112.

In one embodiment of the invention, the support pins and mold components are comprised of hardened tool steel. It is also noted that support pins 116, 118, upon removal, provide passages in leg members 62, 64 between an external atmosphere and internal plug 114. These passages later accommodate electrodes 52, 54.

The plug 114 may be comprised of a wax or a polymer having a melting temperature higher than that of the binder used in the ceramic mixture. Preferably, the melting temperature will be at least about 50–100° C. higher than the melting temperature of the binder used in the ceramic mixture.

After injection molding, the resultant pre-sintered chamber 120 may be stored in a close fit recess of a storage unit 122 to support the relatively low strength body. Moreover, the pre-sintered chamber 120 is stored in unit 122 during a heating stage when the binder and the plug 114 are heated above their melting points and removed from the discharge chamber. A vacuum assist port 124 is provided to facilitate removal of the binder and plug materials. The resultant monolithic arc chamber is advantageously without joins. Beneficially, the internal plug sets the inner shape and volume of the part being molded.

In an alternative embodiment, the ceramic body can be first formed via the removal of the lower melting temperature binder and then subsequent removal of the internal plug. The binder is typically removed by thermopyrollisis. The thermopyrollisis, the porosity of the bisque-fired part is typically about 40–50%.The internal plug can be accordingly manufactured of wax or polymers such as polyethylene having a melting temperature of 50–100° C. above the wax used in the ceramic mixture. Alternatively, it is possible for the plug material to be selected to dissolve in water or other solvents or via gaseous methods allowing the ceramic mixture to be debindered in a later step. Similarly, an alloy such as bismuth/tin, which melts at a relatively low temperature could be used as the internal plug. After removal of the plug and debindering of both the ceramic material, traditional sintering of the part can be completed to form the finished translucent article.

Figure 4:
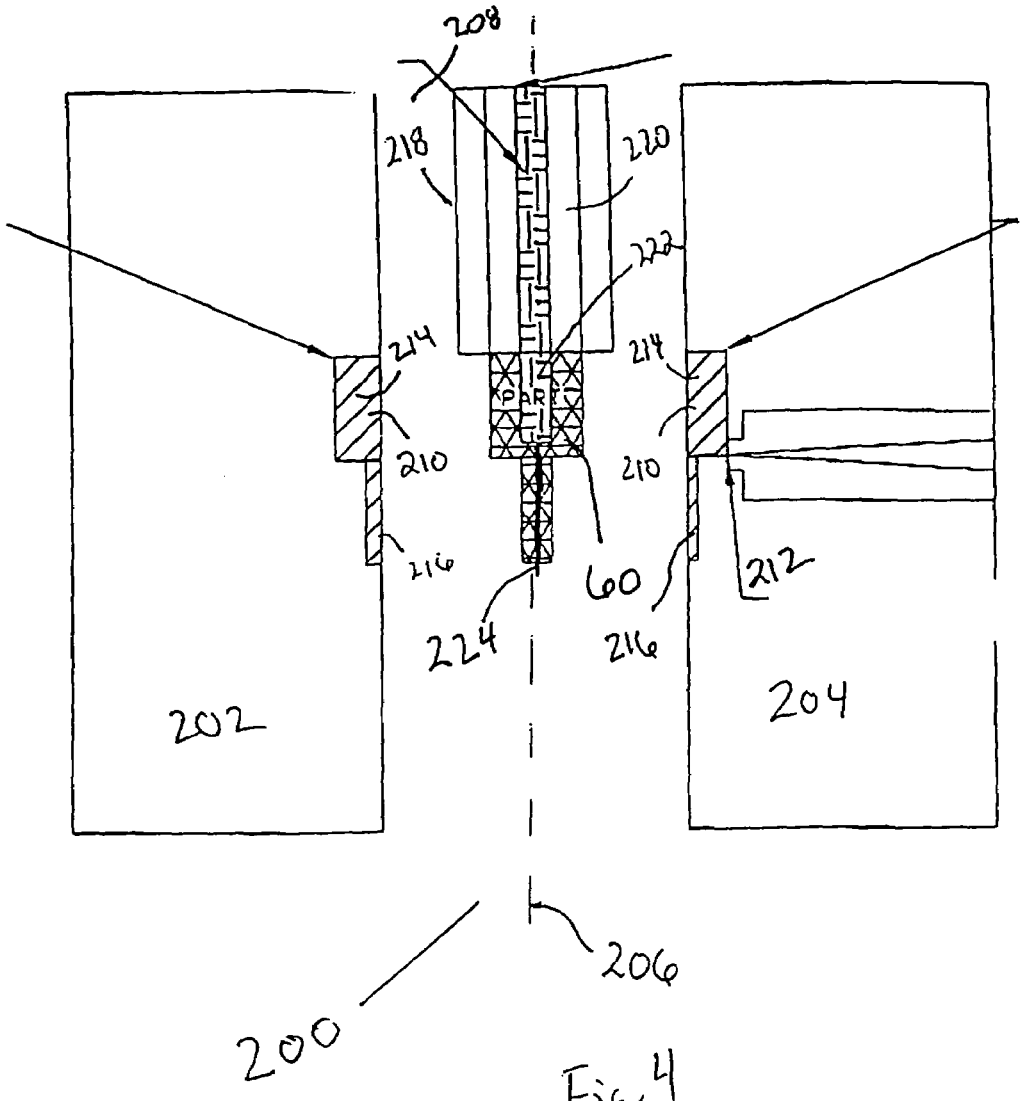
FIG. 4 represents a further representative embodiment of the injection molding process of the present invention.

Turning next to FIG. 4, an alternative embodiment is depicted wherein an injection molded discharge chamber can be removed axially without separation of the die mold itself. This design may provide increased manufacturing rates. Particularly, the mold 200 is constructed of two units 202, 204 (shown separated but mated in use), forming injection mold 206 when joined. The mold includes an opening along an axis 206 including an open end 208 for the removal of the arc discharge chamber 60. The apparatus more specifically includes a chamber 210 in which the discharge chamber 60 is molded. A nozzle inlet 212 is provided for injection of ceramic materials. The cavity 210 more specifically includes a body region 214 and a leg member region 216. A core element 218 is positioned within the mold 200 to facilitate formation of the inner dimensions of the arc chamber. The core element 218 includes a main body 220 and a chamber forming extension 222. The core main body 220 seals the upper region of the cavity 210. The core element 218 also includes a leg bore forming pin 224. Advantageously, the chamber forming extension 222 may include a cooling mechanism (e.g. water or air circulating core). After injection of the ceramic material and sufficient cooling for solidification, the core element 218 can be removed in the direction of axis 206 withdrawing a monolithic chamber and first end member. The discharge chamber 60 can then be removed from core element 218.

One particular benefit of this embodiment is provided by the direct drop ceramic injection. More particularly, nozzle inlet 212 injects ceramic material directly into chamber 210. This design advantageously eliminates the use of the runners typically used in injection molding apparatus. Moreover, prior ceramic arc tube injection molds included nozzle injection into passages ("runners") in the mold body which in turn delivered the ceramic material to individual molding cavities. These runners are problematic with ceramic materials, providing wasted material, a common location for clogging, and often requiring a heated manifold to maintain suitable material viscosity.

More specifically, most injection molding equipment is designed for molding plastic materials. In this regard, the equipment generally provides a high pressure injection of a material at elevated temperature into a molding cavity. After the plastic solidifies, the mold is opened and a part having the shape of the cavity is removed. The injection molding machine usually comprises an injection unit and a clamp unit. The injection unit is typically a reciprocating single-screw extruder that melts the material and injects it into the mold. The clamp unit opens, closes and holds the mold closed against the pressure of injection. Most injection molding equipment is operated by hydraulic power and includes an electric motor and hydraulic pump. A hydraulic cylinder opens and closes the mold and holds the mold closed during injection, another cylinder forces the screw forward injecting the melt into the mold.

Molds are typically custom machined from steel. The molded parts are typically referred to as a "shot". A typical shot from a mold, consists of at least a sprule, runners, gates and parts. The sprule can generally be considered a channel accepting the melt from the extruder and the runners as channels directing the melt to multiple molding cavities. In this regard, a single sprule will typically connect to at least two runners. A gate is typically positioned between the runner and each cavity. After ejection of the parts, the sprule, runner and gate scrap is separated from the part and fed back into the injection unit for reprocessing. This process, while suitable for plastics, is not suitable for the ceramic materials utilized in the manufacture of arc discharge chambers.

When the mold is opened, the part can be removed. The half of the mold attached to a movable platen is often equipped with ejector pins, which push the part out of the cavity while the mold is being opened. While certain modem mold design techniques have been designed to reduce or eliminate sprule and runner scrap, through hot runners, insulated runners, or by designs placing the nozzle directly against the mold cavity, these have not been previously applied to molding of ceramic arc tubes. In this context, it has been found that by positioning the extrusion nozzle adjacent the mold cavity, and/or as a component of the mold platen adjacent the molding cavity, a significant decrease in ceramic scrap and increase in product quality can be achieved.

If the embodiment of FIG. 4 is used, and a second end member is later joined to the monolithic body (see FIG. 2), the densities of the bisque-fired parts used to form the body and the end member are selected to achieve different degrees of shrinkage during the sintering step. The different densities may achieved by using ceramic powders having different surface areas. For example, the surface area of the ceramic powder used to form body may be 6–10 meters squared per gram, while the surface area of the ceramic used to form the end member may be 2–3 meters squared per gram. The finer powder in the body causes the body to have a lower density than the end member made from the coarser powder. Because the body member is less dense than the end member, the body portion shrinks to a greater degree (eg 3–10%) during sintering than the transition portion 114 to form a seal at the interface of the two parts.

In any embodiment of the invention, the sintering step may be carried out by heating the bisque-fired parts in hydrogen having a dew point of about 10–15°. Typically, the temperatures increase from room temperature to about 1300° C. over a two hour period. Next, the temperature is held to about 1300° C. for about 2 hours. Next, the temperature is increased by about 100° C. per hour up to a maximum temperature of about 1850–1880° C. Next, the temperature is held at 1850–1880° C. for about 3.5 hours. Finally, the temperature is decreased from room temperature for two hours. The resulting ceramic material comprises densely sintered polycrystalline aluminum.

Although the invention has been described with reference to exemplary embodiments, various changes and modifications can be made without departing from the scope and spirit of the invention. For example, referring now to FIG. 4, it is feasible that the core member could be machined to provide a second leg element including wherein a pinned extension forms the leg opening and a meltable/decomposable mold is utilized for formation of the chamber. Similarly, the direct drop injection of FIG. 4 could be adjacent and/or in line with the leg element. These and other modifications are intended to fall within the scope of the invention as defined by the following claims.

What is claimed is:

1. A method of making a ceramic discharge chamber comprising the steps of forming a mixture comprised of a ceramic powder and a binder and injecting said mixture into a die and around a mold to form a monolithic article having a main body defining an arc chamber and at least one end member wherein said mold is removable from said monolithic article after solidification of the mixture, said mold comprises a plug which is removable from said monolithic article after solidification of the mixture by melting or decomposition of the plug, wherein removable pins support said plug during injection of said mixture into the die and create lead through or electrode openings in said at least one end member.

2. The method of claim 1 wherein said ceramic powder is alumina.

3. The method of claim 1 wherein said binder is a wax.

4. The method of claim 1 wherein said plug is a wax or polymeric material melting at a temperature greater than the melting temperature of said binder.

5. The method of claim 1 wherein said ceramic discharge chamber is slidably removed from said die along a longitudinal axis of said main body.

6. The method of claim 5 wherein said ceramic discbarge chamber is also slidably separated from said mold.

7. The method of claim 5 wherein said ceramic powder is alumina.

8. The method of claim 5 wherein said binder is a wax.

9. The method of claim 1 wherein said monolithic article includes a main body and two end members.

10. A method of making a ceramic discharge chamber comprising the steps of forming a mixture comprised of a ceramic powder and a binder and injecting said mixture into a cavity within a die wherein said die is of a runnerless design having nozzle substantially directly injecting said mixture into the cavity.

11. The method of claim 10 wherein said nozzle comprises an element of said die.

* * * * *